United States Patent [19]

Chambley et al.

[11] 4,080,772

[45] Mar. 28, 1978

[54] APPARATUS FOR DEPOSITING MATERIALS IN A CONTAINER

[75] Inventors: Phillip W. Chambley; Alan H. Norris, both of Rome, Ga.

[73] Assignee: Champion International Corporation, Stamford, Conn.

[21] Appl. No.: 794,360

[22] Filed: May 6, 1977

[51] Int. Cl.[2] ..... B65B 63/04

[52] U.S. Cl. ..... 53/116; 28/289; 242/82; 242/83

[58] Field of Search ..... 53/116; 28/289; 242/82, 242/83

[56] References Cited

U.S. PATENT DOCUMENTS

| | | | |
|---|---|---|---|
| 3,270,977 | 9/1966 | Tillou | 28/289 X |
| 3,378,898 | 4/1968 | Mendes | 53/116 X |

*Primary Examiner*—Travis S. McGehee

*Attorney, Agent, or Firm*—Evelyn M. Sommer

[57] ABSTRACT

An apparatus for depositing a continuous strand of material into a container includes a rotatable elbow-shaped tubular member having a substantially vertical portion and an angled portion. One end of a tubular sleeve is rotatably mounted on the angled portion of the elbow member, and the other end of the sleeve being free. The sleeve has an assymetric, substantially V-shaped slot which divergingly extends from an intermediate portion of the sleeve to the free end thereof. Means for rotating the elbow member and sleeve member about the vertical axis of the elbow member and simultaneously rotating the sleeve member about its own longitudinal axis are provided such that the material is deposited in concentric circles of varying radii as the material is selectively delivered from a different portion of the sleeve's V-shaped slot.

12 Claims, 5 Drawing Figures

APPARATUS FOR DEPOSITING MATERIALS IN A CONTAINER

BACKGROUND OF THE INVENTION

The subject invention relates to the plaiting or piddling of yarn, woven tapes, tow, staple, sliver, rope, or any other substantially continuous length of textile material. In the textile industry, there are many situations in which a continuous strand of material is produced and where it is necessary to plait or piddle the material into boxes, cans, or other containers for ease of transfer or storage. Aside from storage, it is often desirable to form uniform yarn packages for the purpose of dyeing the yarn. It can be appreciated that while it is desirable to form textile packages which are compact for efficient storage thereof, it is necessary that the material be collected in such a manner so as to avoid tangles, and to allow for easy withdrawal of the strand of material. This is especially important, for example, with weave-de-weave tapes where the weft can be withdrawn from only one direction. In such a situation, the collection container is typically turned upside down and the material withdrawn from the portion of the container that was the bottom thereof during filling. Clearly, such a procedure adds to problems of tangling where the material is not properly deposited. Proper collection of material is also important with respect to the dying thereof in that it is necessary to have a textile package of uniform density so that there is uniform penetration of the dye into the material. When non-uniformly dyed yarn is formed into fabric, the fabric exhibits localized dye spots or streaks which seriously affect its appearance and quality.

Several devices presently exist for depositing strands of textile material into a container. One device employs reciprocating trumpets each moving in a horizontal plane perpendicular to each other. One trumpet deposits the strand along the length of the container while the other trumpet moves the strand along the width of the container. In an alternate embodiment, a single trumpet oscillates in one plane with the container moving back and forth in the other. However, such a system is undesirable in that the reciprocating means cannot rely on simple harmonic motion, because this would result in overfilling the container in its outside or edge portions while underfilling the center portion of the container. Consequently, these devices must include additional structures which render the devices mechanically elaborate and often impractically expensive.

Other material depositing devices, commonly known as "coilers," are available but they also tend to be either complex structures or expensive to manufacture, or both. In addition, known "coilers" are undesirable in that they often insert twist into the material as it is being deposited in a container. Moreover, "coilers" may be effectively used only with containers which are substantially cylindrical in configuration, said containers being inefficient storage means because of the relatively unused space represented by the interstices between containers.

Accordingly, it is an object of the subject invention to provide an apparatus for depositing flexible materials such as tow, tape or fabric into a container in such a fashion that the material fills the container uniformly and prevents tangling of material upon removal from the container.

It is another object of the subject invention to provide an apparatus having the above characteristics which can be effectively used with boxes as well as cylindrical containers.

It is a further object of the subject invention to provide an apparatus having the above characteristics which is simple in construction and inexpensive to manufacture.

SUMMARY OF THE INVENTION

In accordance with the subject invention an apparatus for depositing flexible material into a container comprises a rotatable tubular elbow-shaped member having a substantially vertical portion and an angled portion. A tubular sleeve member is rotatably mounted at one end on the angled portion of the elbow, the other end of the sleeve being free. The sleeve member includes an assymetric substantially V-shaped slot, the slot divergingly extending from an intermediate portion of the sleeve to the free end thereof. The subject apparatus further includes means for rotating the elbow member about its vertical axis such that the sleeve member secured thereto rotates as well and traces a circle in a horizontal plane. Typically, the vertical portion of the elbow member is fixed within a drive pulley which is carried on a mounting plate. The pulley may be substantially square in configuration. In addition, the subject apparatus includes means for simultaneously rotating the sleeve member about its longitudinal axis, thus varying the position in the V-shaped slot from which the material is being delivered.

In operation, the material to be deposited passes through the elbow member, through the sleeve member, and out the slot thereof. The rotation of the elbow member causes the material to be delivered to the container in a circular motion, the diameter of the circle being dictated by the length of the sleeve. In addition, as the sleeve rotates about its longitudinal axis, the material is deposited in circles of varying diameter depending upon the position in the V-shaped slot from which the material is being delivered. Further, because the material is passed through the tubular members at a faster rate than the rotation of the pulley, the material is not deposited in straight concentric circles but rather is laid orbitally in loops or coils.

DESCRIPTION OF THE PREFERRED EMBODIMENTS

Figure 1:
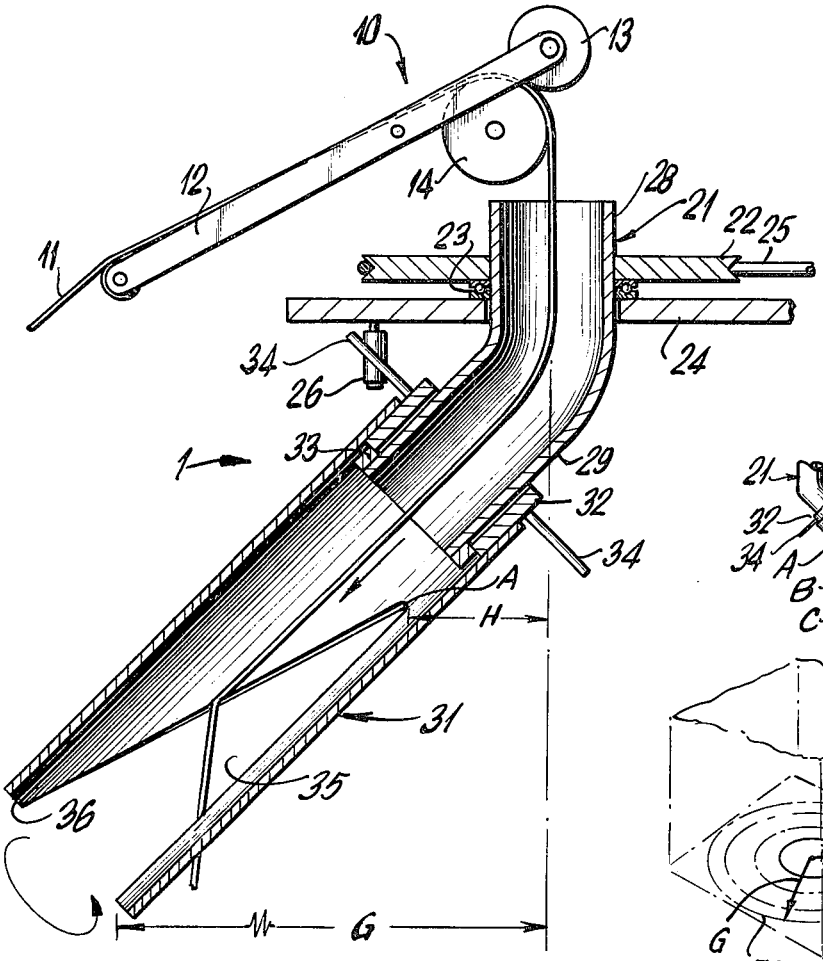
FIG. 1 is an elevational cross-sectional view of the apparatus of the subject invention.

Referring to FIG. 1, means for feeding flexible strand material such as yarn, woven tapes, tow, sliver, staple, or any other substantially continuous length of textile material into the apparatus 1 of the subject invention is designated generally by reference numeral 10. More particularly, feeding means 10 typically includes counter-rotating weight roll 13 and overspeed roll 14, which are in mechanical engagement with each other. Web 11, supplied from a loom (not shown), for example, is gripped between said counter-rotating rolls 13, 14 and advanced therebetween for feeding to the depositing apparatus 1. Preferably, feeding means 10 further includes a tension rod 12 which is secured to weight roll 13. In operation, web 11 passes over tension rod 12, is gripped between counter-rotating rolls 13, 14 and advanced therethrough, and fed into depositing apparatus 1. If the tension of web 11 suddenly increases as it passes over tension rod 12, for example if the loom stops, tension rod 12 will be pulled downward, thereby lifting weight roll 13. As a result, the web 11 can no longer be advanced and fed into depositing apparatus 1.

Still referring to FIG. 1, the depositing apparatus 1 of the subject invention includes an elbow-shaped tubular member 21, having a substantially vertical portion 28 and an angled portion 29. Preferably, elbow 21 is fixedly secured within an annular pulley 22, the vertical axis of the elbow 21 being in register with the vertical axis of the pulley 22.

Typically, pulley 22 is carried on a mounting plate 24 by bearing 23, and driven by means of drive belt 25 such that elbow 21 may rotate about its vertical axis relative to mounting plate 24. Preferably, the vertical axis of mounting plate 24 is in register with the vertical axes of elbow member 21 and pulley 22.

The depositing apparatus 1 further includes a tubular sleeve 31, one end of said sleeve being rotatably mounted on angled portion 29 of elbow 21 via bushing 32 and held in angled portion 29 by means of keeper ring 33. Sleeve 31 terminates at a free end 36, and has an assymetric, substantially V-shaped slot 35 which divergingly extends from an intermediate point A in the sleeve 31 to the free end 36 thereof. Preferably, V-shaped slot 35 is a right triangle, and as will be described infra, the dimensions of said triangular slot 35 are factors dictating how web 11 will be deposited. It can be appreciated that as pulley 22 is driven, elbow 21 and sleeve 31 secured thereto, rotate about the vertical axis of elbow 21, and map out a circle existing in a horizontal plane. As a result, web 11, which is delivered from sleeve 31, is delivered in a circular motion, the size of the circle, of course, being dictated by the effective length of sleeve 31.

In addition, in accordance with the subject invention, it is also necessary that means be included for simultaneously rotating sleeve 31 about its own longitudinal axis as said sleeve rotates about the vertical axis of elbow 21. Typically, said independent rotation of the sleeve 31 about its own longitudinal axis may be achieved by a pick-roll mechanism. More particularly, mounting plate 24 preferably includes one or more picking rollers 26, fixedly secured thereto, which engage with one or more protruding fingers 34, which radially extend around the periphery of bushing 32. As sleeve 31 rotates about the vertical axis of elbow 21, fingers 34 pick or contact stationary rollers 26 on mounting plate 24 and cause sleeve 31 to rotate about its longitudinal axis. Of course, as sleeve 31 rotates about its longitudinal axis, the position of slot 35 will vary, as will the delivery of web 11 along the hypotenuse of triangular slot 35.

Figure 2:
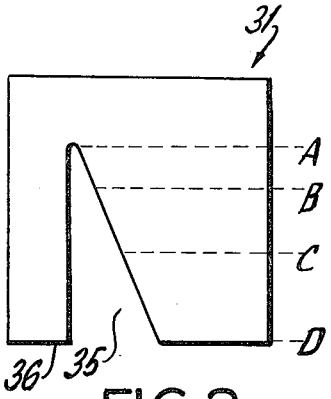
FIG. 2 is a plan view of the sleeve member of the apparatus of the subject invention in which said sleeve member has been cut open and laid flat.
Figure 3:
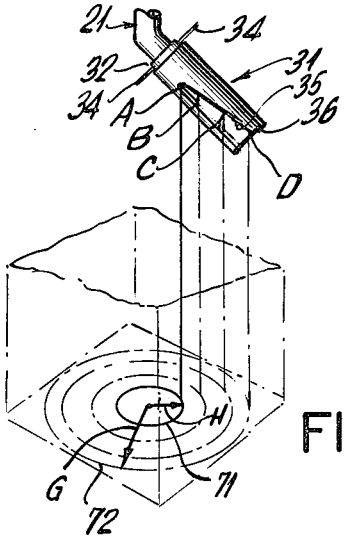
FIG. 3 is an elevational view in which material is being deposited in a container from four different positions in the sleeve member of the subject invention.

Referring to FIG. 2 there is illustrated a plan view of sleeve 31 which has been cut, unrolled, and laid flat. Also depicted in FIG. 2 are several possible points in sleeve 31, namely, A, B, C, and D, from which web 11 may be dropped or delivered to a container as sleeve 31 rotates about its longitudinal axis. Referring to FIG. 3 in conjunction with FIG. 2 it is apparent that when sleeve 31 is disposed so that web 11 will be delivered from point A, said web 11 will be delivered in a circle 71 having the smallest possible radius, i.e. H. When sleeve 31 is disposed so that web 11 is delivered from point D, said web 11 will be delivered in a circle 72 having the largest possible radius, i.e. G. When sleeve 31 is disposed so that web 11 will be delivered from a point intermediate A and D, such as for example B or C, said web 11 will be delivered in a circle having a radius intermediate in size. In other words, the relative position of slot 35 as sleeve 31 rotates about its longitudinal axis dictates the effective length of sleeve 31, and ultimately the radius of the circle of material delivered. And, as sleeve 31 rotates about the vertical axis of elbow 21, and simultaneously rotates about its own longitudinal axis, web 11 is being delivered in a series of concentric circles of varying radii.

Figure 4:
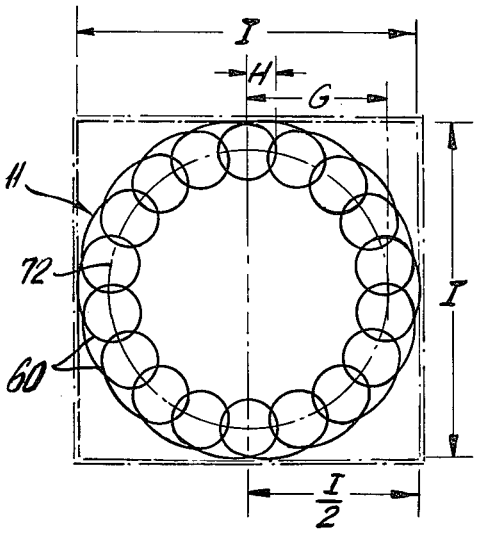
FIG. 4 is a plan view of material which has been deposited into a container by the apparatus of the subject invention.

Referring to FIG. 4 there is illustrated a plan view of web 11 that has been deposited or delivered from point D of sleeve 31 as illustrated in FIGS. 2 and 3. It should be noted that the material has not been deposited in a straight circle but rather has been deposited orbitally with the formation of loops or coils 60, and that circle 72, illustrated in FIG. 3, is in reality a circle formed by connecting the centers of coils 60 of FIG. 4. This formation of loops or coils 60 is effected because the web 11 is typically advanced through elbow 21 and sleeve 31 at a rate very much faster than the rate of rotation of elbow 21 and sleeve 31 about the vertical axis of elbow 21, said rotation generally being on the order of ⅓ to 2 revolutions per minute. Generally, the size of loops 60 is dictated by the relative stiffness of web 11. However, the size of circles 60 may be mechanically controlled somewhat by varying the speed of pulley 22.

As indicated above the dimensions of sleeve 31 and of V-shaped slot 35 contained therein dictate how web 11 will be deposited. Of course, it will be appreciated that the size of the natural coil or loops 60 inherent in web 11 is also a factor. Referring to FIG. 4, if, for example, the natural coil of the material of web 11 forms loops 60 having a diameter (2H) of approximately 7 inches, and the container to be filled is a square having a side dimension I, such as 42 inches, it is clear that one-half of the container I/2 will accommodate three loops 60 across its width. It is also clear that the centers of the inside and outside loops fall approximately a distance 3½ inches (H) and 17½ inches (G) respectively from the center of the container. As a result, referring to FIG. 1, point A of sleeve 31 must be 3½ inches (H) from the vertical axis of elbow 21, and the free end 36 of sleeve 31 must be 17½ inches (G) from said vertical axis of elbow 21. In addition, it should be noted that because the ratio of the areas of the outer to inner concentric circles fromed by the rotation of sleeve 31 about the vertical axis, i.e., 72 and 71 respectively, of FIG. 3, is $17.5^2:3.5^2$ or 25:1, the narrow portion or uppermost portion of triangular slot 35 must occupy 360 ÷ 25 or 14.4°.

Referring to FIGS. 1 and 2 it should be noted that the hypotenuse of slot 35 forms the trailing or guide edge by which web 11 is delivered. This is so because it is necessary for the turning helix to exert an outward force on web 11 as sleeve 31 rotates about the longitudinal axis. In other words, as sleeve 31 rotates about its longitudinal axis, the hypotenuse of slot 35 engages web 11 and guides its delivery from point A at one extreme, through its intermediate portions such as B and C, to point D at the other extreme, then back to point A. Of course, the number and position of fingers 34 dictates from what positions in the slot 35 web 11 is delivered. The angle of slope of the hypotenuse must be determined so as to insure level filling of a container said slope being such that an adequate helix angle is provided, as well as a proper circumference of free end 36 of sleeve 31 for providing a correct dwell ratio for uniform filling. In addition, both the width and slope of slot 35 and the number and relative position of fingers 34 control the amount of material deposited in concentric circles in the container. For example, if more material is needed near the center of the container, slot 35 can be made wider or radial fingers 34 arranged such that slot 31 appears on the bottom more frequently, or both.

Figure 5:
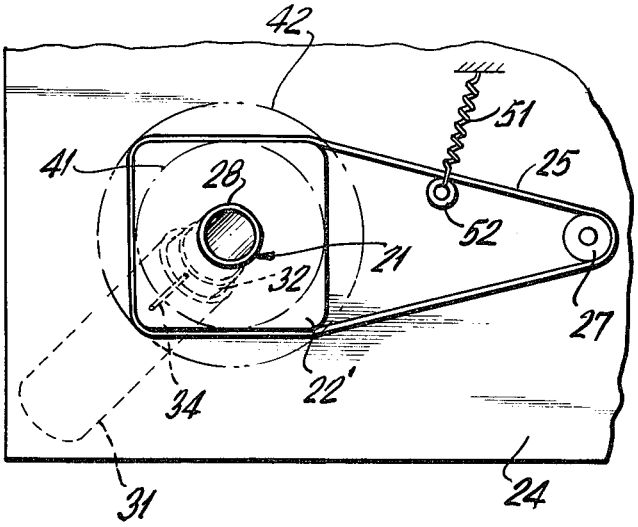
FIG. 5 is a plan view of an alternate embodiment of the apparatus of the subject invention.

In practice, although the web 11 is delivered in a circular motion, it has been found that the natural coil of the material causes the material to wander into the corners of the container. However, to insure complete filling, an alternate embodiment of the apparatus of the subject invention may be employed which, as illustrated in FIG. 5 includes a pulley 22' which is generally rectangular in configuration. Pulley 22' slows down as the corners are being driven and speeds up when the sides are driven. Because of the registration of elbow 21 in pulley 22', the corners of pulley 22' coincide with the corners of the container. As a result, as elbow 21 and sleeve 31 rotate slower as the corners are being driven, and because of the natural coil of the material, more material is deposited in the corners of the container than in the sides, and the corners of the container are filled. Preferably, idler spring and pulley 51 and 52 respectively, are included to take up any slack in drive belt 25 which results from differences in winding circumference.

In summary, the subject invention provides a new and improved apparatus for depositing a continuous strand of material into a container such that the material is deposited uniformly, and may be removed from the container easily, without snarls or tangles. Unlike many of the known devices, the subject apparatus is quite simple in construction and inexpensive to manufacture, the structure comprising simple rotary devices. In addition, the subject apparatus may effectively be used in conjunction with rectangular containers, as well as cylindrical cans, thus permitting maximum efficiency of storage space.

While there have been described herein what are at present considered preferred embodiments of the invention, it will be obvious to those skilled in the art that many modifications and changes may be made therein without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

What is claimed is:

1. An apparatus for depositing material into a container comprising:

support means;

an elbow-shaped tubular member rotatably mounted within said support means, said elbow-shaped member having a substantially vertical portion and an angled portion;

a tubular sleeve member, one end thereof being rotatably mounted on the angled portion of said elbow-shaped member, the other end of said sleeve member being free, said sleeve member having an assymetric substantially V-shaped slot, said slot divergingly extending from an intermediate portion of said sleeve to the free end thereof;

means for rotating said elbow member and sleeve member about the vertical axis of said elbow member; and means for simultaneously rotating said sleeve member about its longitudinal axis as both the sleeve member and elbow member rotate about the vertical axis of the elbow member whereby as said material extends through said elbow-shaped member and said sleeve member, it is delivered to the container from a different portion of the V-shaped slot.

2. An apparatus for depositing material into a container as recited in claim 1 where the V-shaped slot is a right triangle in configuration with the material being delivered from varying points on the hypotenuse thereof.

3. An apparatus for depositing material into a container as recited in claim 1 in which the means for rotating said elbow member and sleeve member about the vertical axis of said elbow member comprises: a pulley carried on said support means, the vertical portion of said elbow member being fixedly secured within said pulley, the vertical axis of said pulley being substantially in register with the vertical axis of said elbow member; and means for driving said pulley.

4. An apparatus for depositing material into a container as recited in claim 3 in which said support means, said pulley, and the vertical portion of said elbow-shaped member are coaxial.

5. An apparatus for depositing material into a container as recited in claim 3 in which the pulley is substantially rectangular in configuration.

6. An apparatus for depositing material into a container as recited in claim 3 in which the means for simultaneously rotating said sleeve member about its longitudinal axis as both the sleeve member and elbow member rotate about the vertical axis of said elbow member comprises a contact member, fixedly secured to the support means and protruding therefrom, and a finger member fixedly secured to the outer periphery of the sleeve member and radially extending therefrom said finger member selectively engaging said contact member as the sleeve member rotates about the vertical axis of the elbow member.

7. An apparatus for depositing material into a container as recited in claim 3 in which the means for driving said pulley comprises a driver motor and an endless belt; said belt being disposed around the periphery of the pulley and secured to said motor.

8. An apparatus for depositing material into a container as recited in claim 5 further including means for maintaining the proper tension in the drive belt as different portions of said pully are being driven.

9. An apparatus for depositing material into a container as recited in claim 8 in which said tension maintaining means comprises an idler spring and pulley.

10. An apparatus for depositing a continuous strand of material into a container comprising:

a horizontally disposed mounting plate having a receiving opening in the center thereof, said mounting plate further including a contact member, fixedly secured to and perpendicular the bottom of said mounting plate;

a pulley member generally rectangular in configuration disposed parallel to and engaging said mounting plate, said pulley member having a receiving opening substantially in register with the receiving opening of said mounting plate;

a rotatable elbow-shaped tubular member having a substantially vertical portion and an angled portion, the vertical portion of said elbow-shaped member being disposed within the receiving openings of said pulley member and said mounting plate, and secured to said pulley member such that the vertical axes of said pulley member, mounting plate, and vertical portion of said elbow-shaped member are substantially in register;

a tubular sleeve member, one end thereof being rotatably mounted on the angled portion of said elbow-shaped member, the other end of said sleeve member being free, said sleeve member having an assymetic substantially V-shaped slot divergingly extending from an intermediate point in said sleeve to the free end thereof, said slot being a right triangle in configruation, said sleeve member further including a finger member secured to and radially extending from the outer periphery of said sleeve member; and means for rotating said pulley member such that said elbow-shaped member and sleeve member rotate about the vertical axis of said elbow-shaped member, said finger member of the sleeve member engaging with the contact member of said mounting plate, such engagement effecting the simultaneous rotation of said sleeve member about its own longitudinal axis whereby the material being deposited is delivered in concentric circles of varying radii as the material is delivered from a different portion of the hypotenuse of the triangular slot of the sleeve member.

11. An apparatus for depositing material into a container comprising:

support means;

an elbow-shaped tubular member rotatably mounted within said support means, said elbow-shaped member having a substantially vertical portion and an angled portion;

a tubular sleeve member, one end thereof being rotatably mounted on the angled portion of said elbow-shaped, while the other end thereof has an assymetrical slot formed therein, said slot divergingly extending from an intermediate portion of said sleeve to the free end thereof;

means for rotating said elbow member and sleeve member about the vertical axis of said elbow member;

means for rotating said sleeve member about its longitudinal axis; and means for feeding said material through said elbow-shaped member and said sleeve member, whereby said material is delivered from various portions of the slot in said sleeve member prior to being deposited into said container.

12. An apparatus for depositing material into a container as in claim 11 wherein said means for rotating said elbow member and said sleeve member includes a pulley fixedly secured to said elbow member, with the plan of said pulley being substantially rectangular in configuration.

* * * * *